US010045627B2

(12) United States Patent
Simon et al.

(10) Patent No.: US 10,045,627 B2
(45) Date of Patent: Aug. 14, 2018

(54) WORKSURFACE ASSEMBLY, BODY SUPPORT MEMBER HAVING A WORKSURFACE AND METHOD FOR THE USE AND ASSEMBLY THEREOF

(71) Applicant: STEELCASE INC., Grand Rapids, MI (US)

(72) Inventors: Jeffrey David Simon, Portland, MI (US); Marc Eberlein, Hudsonville, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 15/404,936

(22) Filed: Jan. 12, 2017

(65) Prior Publication Data

US 2017/0208952 A1 Jul. 27, 2017

Related U.S. Application Data

(60) Provisional application No. 62/286,753, filed on Jan. 25, 2016.

(51) Int. Cl.

| | |
|---|---|
| ***A47C 7/68*** | (2006.01) |
| ***A47C 7/00*** | (2006.01) |
| ***A47C 7/70*** | (2006.01) |

(52) U.S. Cl.

CPC ..... *A47C 7/68* (2013.01); *A47C 7/004* (2013.01); *A47C 7/70* (2013.01)

(58) Field of Classification Search

CPC .. A47C 3/30; A47C 7/68; A47C 7/004; A47B 9/00; A47B 11/00

USPC ..... 108/42, 49, 139, 142, 150, 25, 26, 147, 108/50.01, 50.02

See application file for complete search history.

(56) References Cited

U.S. PATENT DOCUMENTS

| | | | |
|---|---|---|---|
| 336,220 | A | 2/1886 | Farrar |
| 564,044 | A | 7/1896 | Berkmeyer |
| 595,284 | A | 12/1897 | Baum |
| 951,145 | A | 3/1910 | McGenniss |
| 1,023,620 | A | 4/1912 | Burge |
| 1,231,301 | A | 6/1917 | Schlanger |
| 1,234,309 | A | 7/1917 | Dubben |
| 1,299,810 | A | 4/1919 | Toole |
| 1,324,503 | A | 12/1919 | Hirsch |

(Continued)

FOREIGN PATENT DOCUMENTS

| | | | |
|---|---|---|---|
| CA | 2897295 | * | 1/2017 |
| JP | 2008200221 A | | 9/2008 |

*Primary Examiner* — Janet M Wilkens

(74) *Attorney, Agent, or Firm* — Brinks Gilson & Lione

(57) ABSTRACT

A worksurface assembly includes a support having a first mounting portion defining a first pivot axis and a second mounting portion defining a second pivot axis, with the second mounting portion spaced above the first mounting portion. The first and second pivot axes are spaced apart. A pivot member is pivotally coupled to the second mounting portion and is pivotable relative to the support about the second pivot axis. A worksurface is rotatably coupled to the pivot member about a third pivot axis, which is spaced apart from the second pivot axis. The worksurface overlies the second and third pivot axes in all positions. The worksurface may be associated with a body support assembly. Methods of using and assembling the worksurface assembly are also provided.

21 Claims, 7 Drawing Sheets

(56) References Cited

U.S. PATENT DOCUMENTS 1,337,221 A 4/1920 Hansen
1,524,766 A 2/1925 Van Den Boogaard
1,529,022 A * 3/1925 Fraser ..... A47B 27/02 108/6
1,634,929 A 7/1927 Blitz et al.
1,648,717 A 11/1927 Blitz et al.
1,828,311 A 10/1931 Bink
2,217,943 A 10/1940 Carlson
2,225,735 A 12/1940 Cederquist
2,329,697 A 9/1943 Davies
2,535,112 A 12/1950 Woody
2,691,407 A 10/1954 Kupski
2,921,623 A 1/1960 Humphries et al.
2,954,073 A 9/1960 Junkunc
3,212,816 A 10/1965 Nordmark
3,216,765 A 11/1965 Junkunc
3,353,866 A 11/1967 Chapman et al.
3,379,145 A 4/1968 Lieberman
3,479,084 A 11/1969 Van Ryn
3,504,927 A 4/1970 Seki
3,572,831 A 3/1971 Barecki et al.
3,586,367 A 6/1971 Cincotta
3,598,442 A 8/1971 Miller
3,601,443 A 8/1971 Jones
3,637,185 A 1/1972 Mikos et al.
3,709,555 A 1/1973 Ostertag
3,712,669 A 1/1973 Cates
3,713,618 A 1/1973 Hendrickson et al.
3,751,759 A 8/1973 Duncan
3,751,845 A 8/1973 van Leeuwen
3,796,430 A 3/1974 Sudo
3,859,930 A 1/1975 Sherwin
4,025,083 A 5/1977 Saint
4,123,078 A 10/1978 Murakami
4,136,908 A 1/1979 Crayne
4,140,311 A 2/1979 Murakami
4,171,132 A 10/1979 Kassai
4,171,847 A 10/1979 Tukui
D254,610 S 4/1980 Kassai
4,203,624 A 5/1980 Hopkins
4,215,449 A 8/1980 Loikitz
4,216,994 A 8/1980 Benoit
4,225,146 A 9/1980 Takeuchi
4,371,207 A 2/1983 Wilking et al.
4,372,605 A 2/1983 Cervantes
4,500,134 A 2/1985 Kaneko et al.
4,546,708 A * 10/1985 Wilburth ..... A47B 11/00 108/103
4,591,206 A 5/1986 Pribble
4,645,167 A 2/1987 Hardwick
4,672,898 A 6/1987 Davidson
4,687,167 A 8/1987 Skalka et al.
4,728,067 A 3/1988 Steinmetzer et al.
4,770,410 A 9/1988 Brown
4,848,833 A 7/1989 Grall
4,861,102 A 8/1989 Fuller
4,977,848 A 12/1990 Currey
5,070,969 A 12/1991 Neumüller
5,071,149 A 12/1991 Perego
5,083,806 A 1/1992 Brown
5,087,096 A 2/1992 Yamazaki
5,169,210 A 12/1992 Fricano
D332,703 S 1/1993 Gulliver
5,228,708 A 7/1993 Verdugo
5,265,838 A 11/1993 Kjellman
5,275,465 A 1/1994 Gulliver et al.
5,281,001 A 1/1994 Bergsten et al.
5,352,014 A 10/1994 Allen
5,490,710 A 2/1996 Dearing et al.
5,501,419 A 3/1996 Huang
5,529,374 A 6/1996 Wimberly, Jr.
5,547,247 A 8/1996 Dixon
5,573,301 A 11/1996 Scott
5,601,331 A 2/1997 Austin, Jr. et al.
5,630,648 A 5/1997 Allard et al.
5,653,499 A 8/1997 Goodall
5,669,107 A 9/1997 Carlsen et al.
D385,423 S 10/1997 Shields
5,683,065 A 11/1997 Allen
5,816,649 A 10/1998 Shields
5,845,946 A 12/1998 Phoon
5,884,974 A 3/1999 Bergsten et al.
5,887,948 A 3/1999 Hannes
5,890,691 A 4/1999 Payne
5,899,526 A 5/1999 Lapointe et al.
5,909,864 A 6/1999 Wang
5,931,528 A 8/1999 Shields
5,954,393 A 9/1999 Perrin
6,022,077 A 2/2000 Kirkland et al.
6,053,577 A 4/2000 Arko et al.
6,059,357 A 5/2000 Peart
6,059,366 A 5/2000 Hu
6,073,997 A 6/2000 Koh
6,079,786 A 6/2000 Kirkland et al.
6,116,183 A 9/2000 Crow et al.
6,142,559 A * 11/2000 Sorel ..... A47C 7/70 108/48
D439,207 S 3/2001 Liu
6,224,149 B1 5/2001 Gevaert
6,279,864 B1 8/2001 Carnahan et al.
6,315,262 B1 11/2001 Hur
6,352,302 B1 3/2002 Piretti, Jr.
6,375,257 B1 4/2002 Wooding et al.
6,412,862 B1 7/2002 Dickerson et al.
6,422,646 B1 7/2002 McNally
6,554,364 B1 4/2003 Dammernann et al.
6,669,282 B2 12/2003 Piretti
6,685,264 B2 2/2004 Mullen et al.
6,773,060 B2 8/2004 Sher et al.
6,776,452 B2 8/2004 Onishi
6,830,294 B2 12/2004 Berthiaume
6,837,539 B1 1/2005 Casey
6,877,811 B1 4/2005 Garelick
6,899,385 B2 5/2005 Pernicka et al.
7,000,289 B2 2/2006 Cedrone
7,017,988 B2 3/2006 Tornero et al.
7,073,853 B2 7/2006 Onishi
7,100,977 B2 9/2006 Burwell et al.
7,134,719 B2 11/2006 Moglin et al.
7,143,701 B2 12/2006 Lindstrom et al.
7,210,736 B1 5/2007 Large
7,216,929 B2 5/2007 Lang et al.
7,216,930 B2 5/2007 Steenson
7,350,866 B2 4/2008 Billger et al.
7,370,910 B2 5/2008 Piretti
7,380,886 B1 6/2008 Copello
7,452,032 B1 11/2008 Roleder et al.
7,478,868 B2 1/2009 Figueras Mitjans
7,506,923 B1 3/2009 Gauss
7,530,632 B2 5/2009 Kaloustian et al.
7,530,639 B2 5/2009 Groelsma et al.
D612,640 S 3/2010 Noiseux
7,673,942 B2 3/2010 Tuckey et al.
7,703,844 B2 4/2010 Gevaert
D636,612 S 4/2011 Overthun et al.
D636,613 S 4/2011 Overthun et al.
7,954,696 B2 6/2011 Wingard
8,056,874 B2 11/2011 Goodwin et al.
D674,615 S 1/2013 Blomstrom et al.
D690,545 S 10/2013 Blomstrom et al.
D694,054 S 11/2013 Blomstrom et al.
8,668,257 B2 3/2014 Wu
8,696,056 B2 4/2014 Corcorran et al.
8,874,644 B2 11/2014 Edinger et al.
8,905,817 B2 12/2014 Rowe et al.
8,985,684 B2 3/2015 Zheng et al.
D729,529 S 5/2015 Robins et al.
D729,530 S 5/2015 Robins et al.
9,044,087 B1 6/2015 Corcorran et al.
9,044,099 B2 6/2015 Bouche
9,060,609 B1 6/2015 Corcorran et al.
2004/0004372 A1 1/2004 Mullen et al.
2006/0061149 A1 3/2006 Tsai
2006/0109257 A1 5/2006 Ambasz

(56) References Cited

U.S. PATENT DOCUMENTS

| | | | | |
|---|---|---|---|---|
| 2007/0284920 | A1 | 12/2007 | Mehaffey et al. | |
| 2008/0231091 | A1* | 9/2008 | Goranson | A47C 7/70 297/135 |
| 2008/0277977 | A1 | 11/2008 | Kagan et al. | |
| 2009/0026812 | A1 | 1/2009 | Figueras Mitjans | |
| 2009/0039692 | A1 | 2/2009 | Tuckey et al. | |
| 2009/0108641 | A1 | 4/2009 | Steenson | |
| 2011/0031785 | A1 | 2/2011 | Steenson | |
| 2011/0187164 | A1* | 8/2011 | Corcorran | A47B 39/00 297/170 |
| 2012/0199051 | A1* | 8/2012 | Edinger | A47B 5/006 108/139 |
| 2014/0091193 | A1* | 4/2014 | Simon | A47B 23/02 248/451 |
| 2014/0097650 | A1 | 4/2014 | Corcorran et al. | |
| 2014/0210237 | A1 | 7/2014 | Corcorran et al. | |
| 2014/0252812 | A1 | 9/2014 | Ton | |
| 2014/0360412 | A1* | 12/2014 | Zaccai | A47B 83/045 108/50.11 |
| 2015/0182018 | A1* | 7/2015 | Gwag | F16M 13/02 248/447 |

* cited by examiner

WORKSURFACE ASSEMBLY, BODY SUPPORT MEMBER HAVING A WORKSURFACE AND METHOD FOR THE USE AND ASSEMBLY THEREOF

This application claims the benefit of U.S. Provisional Application No. 62/286,753, filed Jan. 25, 2016, the entire disclosure of which is hereby incorporated herein by reference.

FIELD OF THE INVENTION

The present application relates generally to a worksurface assembly, and in particular to a pivotable worksurface assembly, together with a body support assembly having a pivotable worksurface and methods for the use and assembly thereof.

BACKGROUND

Individual seating units may be configured with a worksurface arranged above the seat. Likewise, sofas and beds may be configured with a worksurface arranged adjacent to and/or above a body support surface defined by the sofa or bed. The worksurfaces may be used to support various electronic devices, as well as traditional books, papers, trays and other personal items.

Often, the worksurface is fixedly attached to the chair, or other body support member, with ingress and egress provided by way of a recess provided along the side of chair and worksurface. In other embodiments, the worksurface is pivotably attached to the body support member, such that it may be moved out of the way for ingress and egress, or when not needed by the individual using the body support member. In addition, pivotable worksurfaces may be moved to a desired location particularly suited to the position and needs of the user. In these embodiments, the worksurface may be configured to pivot about one or two spaced apart axes. Typically, however, the pivotal arrangement has a limited range of movement, or may be configured with various supports that may impede the movement of the user, or encroach upon the user during use, thereby limiting the overall capabilities of the worksurface.

SUMMARY

Nothing in this section should be considered to be a limitation on the following claims.

In one aspect, one embodiment of a worksurface assembly includes a support having a first mounting portion defining a first pivot axis and a second mounting portion defining a second pivot axis, with the second mounting portion spaced above the first mounting portion. The first and second pivot axes are spaced apart. A pivot member is pivotally coupled to the second mounting portion and is pivotable relative to the support about the second pivot axis. A worksurface is rotatably coupled to the pivot member about a third pivot axis, which is spaced apart from the second pivot axis. The worksurface overlies the second and third pivot axes in all positions.

In another aspect, one embodiment of a body support assembly includes a base, a central support connected to the base and a body support member coupled to the base. In one embodiment, the central support is configured as a vertically adjustable support column. The worksurface, and in particular the first mounting portion, may be coupled to the central support, with the central support defining the first pivot axis.

In yet another aspect, one embodiment of a method for adjusting a position of a worksurface includes rotating a first mounting portion of a support about a first pivot axis, and thereby pivoting the support and a second mounting portion about the first pivot axis. The second mounting portion is spaced above the first mounting portion and defines a second pivot axis spaced apart from the first pivot axis. The method further includes pivoting a pivot member about the second pivot axis, wherein the pivot member defines a third pivot axis spaced apart from the second pivot axis, and rotating a worksurface about the third pivot axis. The worksurface overlies the second and third pivot axes in all of the pivot member and worksurface positions.

A method of assembling a worksurface assembly includes providing a support defining first and second spaced apart pivot axes and pivotably coupling the pivot member to the support at the second pivot axis, wherein the pivot member is pivotable relative to the support. The method further includes rotatably coupling a worksurface to the pivot member about a third pivot axis, wherein the third pivot axis is spaced apart from the second pivot axis, and wherein the worksurface overlies the second and third pivot axes. In one embodiment, the method further includes non-rotatably coupling the pivot member to a lower pan member.

The various embodiments of the worksurface assembly, body support assembly and methods of use and assembly provide significant advantages over other worksurface assemblies and body support assemblies, such as sofas, beds and chairs. For example and without limitation, the worksurface may be moved about three, spaced apart axes, thereby providing the user with additional adjustment capabilities. At the same time, by maintaining the worksurface over the second and third pivot axes, the surface area of the worksurface may be maximized while maintaining maximum adjustment capabilities. In one embodiment, the pivot member extends within the thickness of a worksurface member, such that the worksurface assembly provides a simple, elegant appearance while providing for three unique pivot axes. Moreover, the worksurface may be pivoted about the second axis without encroaching upon and interfering with the user's legs.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Definitions

Figure 1A:
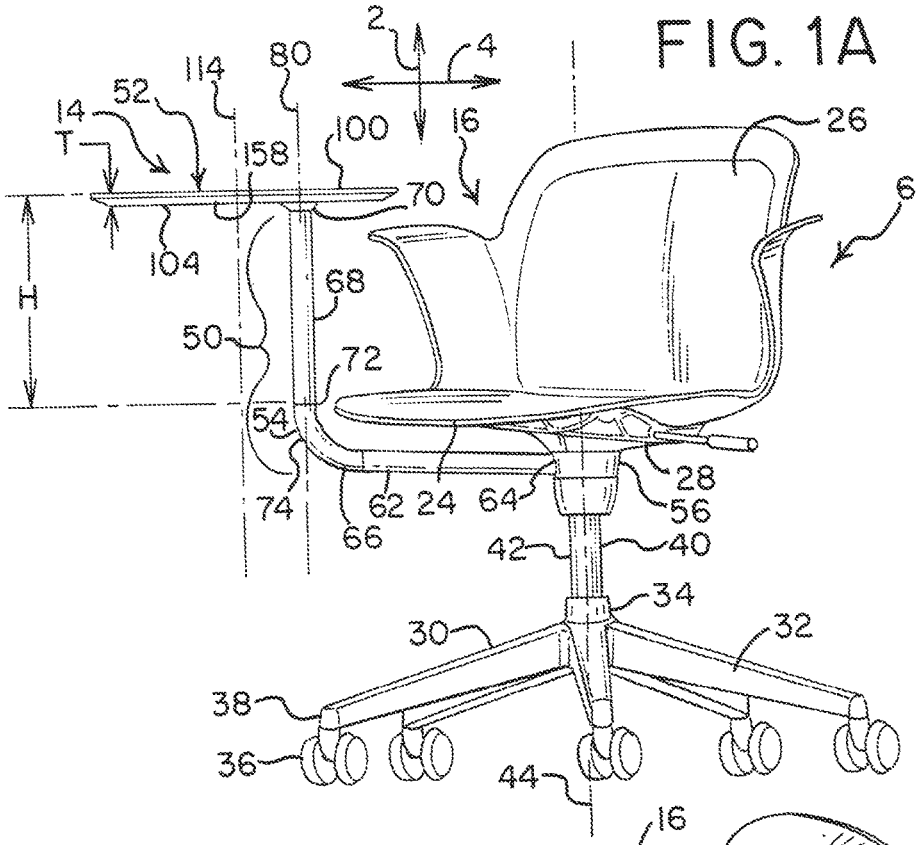
FIGS. 1A-D are perspective views of different body support assembly embodiments configured with a worksurface assembly.

It should be understood that the term "plurality," as used herein, means two or more. The term "longitudinal," as used herein means of or relating to length or the lengthwise direction 2, for example a direction running from along the length of an upright portion 68 or support column 42. The term "lateral," as used herein, means situated on, directed toward or running in a direction 4 orthogonal to the longitudinal direction, for example from side to side of a body support member or worksurface. The term "coupled" means connected to or engaged with, whether directly or indirectly, for example with an intervening member, and does not require the engagement to be fixed or permanent, although it may be fixed or permanent. For example, a support may be coupled to a body support member directly, or indirectly via a support column.

The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components.

The terms "above," "front", "rear", "side", "vertical" and "horizontal", and variations thereof, refer to the body support members 6, 8, 10, 12 and worksurface assembly 14 as shown in FIGS. 1A-D, for example with the body support member being positioned "vertically" above the "base." The terms "rotate" and "pivot" refer to moving or turning about an axis or central point. The phrase "body support assembly" refers to any device configured to support a user's body, including their legs, buttock, back, arms, head, feet, hands or combinations thereof, including without limitation seating units, such as chairs, sofas/couches, vehicular and aircraft seating, stools and beds. The body support assembly is configured with one or more body support members, including without limitation a seat, backrest, armrest, footrest, mattress, cushion or other similar device, or combinations thereof.

Body Support Assembly

Referring to FIGS. 1A-D, a body support assembly 6, 8, 10, 12 includes a body support member 16, 18, 20. Referring to the embodiment of FIGS. 1A and B, the body support assembly 6, 8 is configured as a seating unit, otherwise referred to as a seat structure, having an integrally formed seat 24 and backrest 26 defining the body support member 16. It should be understood that, in alternative embodiments, the seating unit may include only a seat, or a seat and backrest that are separately formed and coupled, for example with a tilt control mechanism. The body support member(s) 16 is connected to and supported by a seat mounting bracket 28. The body support member and seat mounting bracket are rotatably supported by a base 30, 130 about an axis 44 of rotation. In one embodiment, shown in FIG. 1A, the base 30 may be configured with a plurality of arms 32 extending from a central hub 34. The distal ends 38 of the arms may be configured with a ground engaging element 36, such as a foot, caster or glide. The body support member 16, including the seat and the seat mounting bracket in particular, are connected to a central support element 40, configured in embodiment of FIG. 1A as a support column 42. The support column may be vertically adjustable, for example with two or three telescopic elements. The support column 42 may be configured with a pneumatic (e.g., gas spring), mechanical (e.g., screw) or hydraulic adjustment, or combinations thereof. The central support element 40 defines a first pivot axis for a worksurface assembly 14, which is coincident with the axis 44 of rotation for the body support member 16.

Figure 1B:
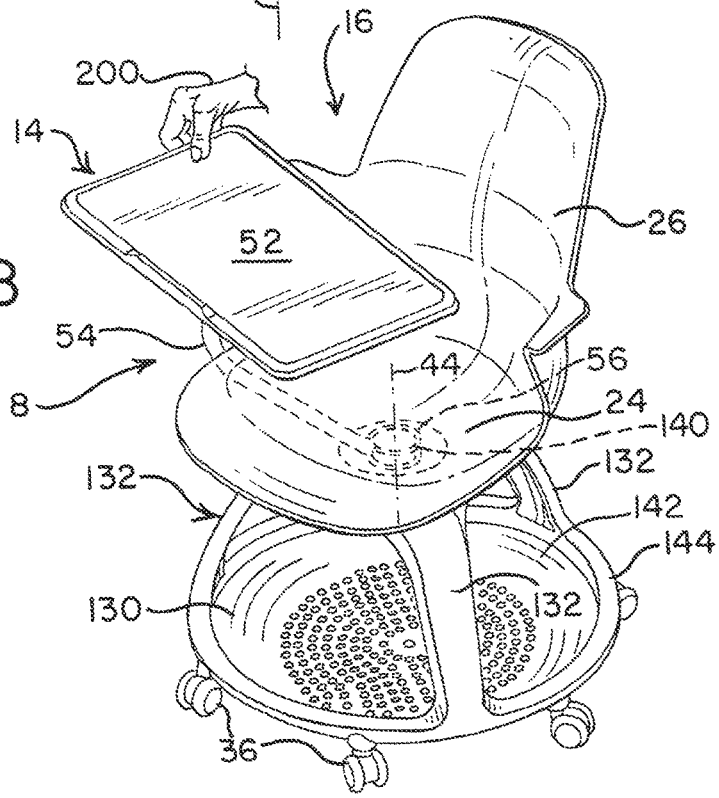

In other embodiments, shown for example in FIG. 1B, a base 130 is configured with legs 132 extending from a central support element 140 located beneath the seat. A central pan 142 connects the legs. Various ground engaging elements 36, shown as casters, may be arranged around a periphery 144 of the central pan.

Figure 1C:
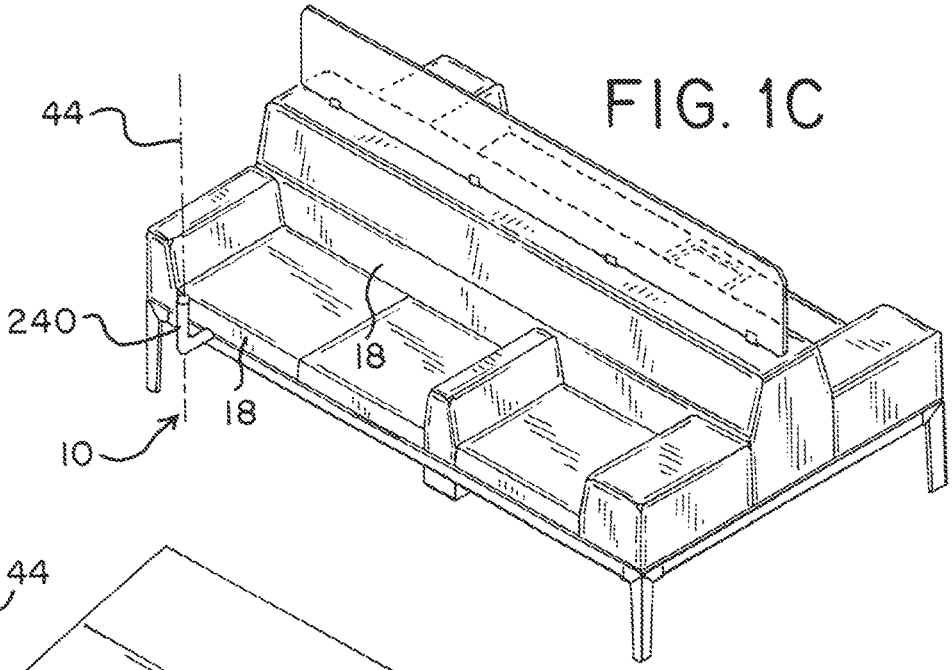

In another embodiment, shown in FIG. 1C, the body support assembly 10 is configured as a sofa or couch, having seat and back cushions defining the body support member 18. The sofa may be convertible, meaning the body support members, or alternatively a separate body support member stored internally, may be arranged or reconfigured to provide a sleeping surface. A central support element 240 is connected to the sofa and is arranged along a side or end portion thereof. It should be understood that the phrase "central support element" refers to a component or feature providing a support defining the first pivot axis 44 about which the worksurface assembly pivots, and does not necessarily refer to a central position or location relative the body support member, although the two may coincide in some embodiments (e.g., FIGS. 1A and B).

Figure 1D:
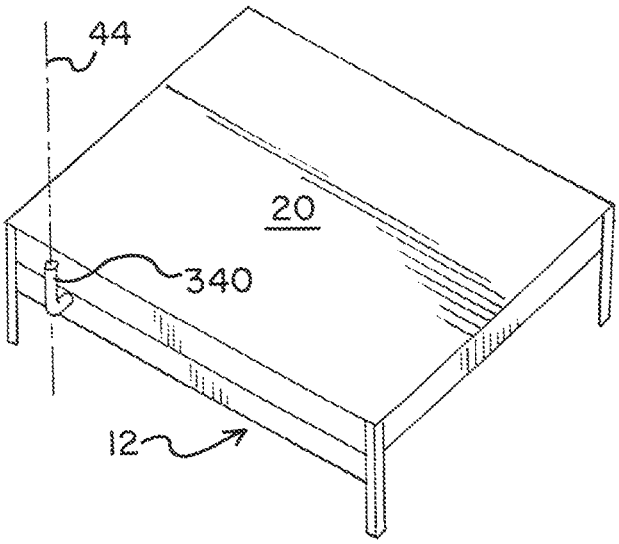
Figure 2:
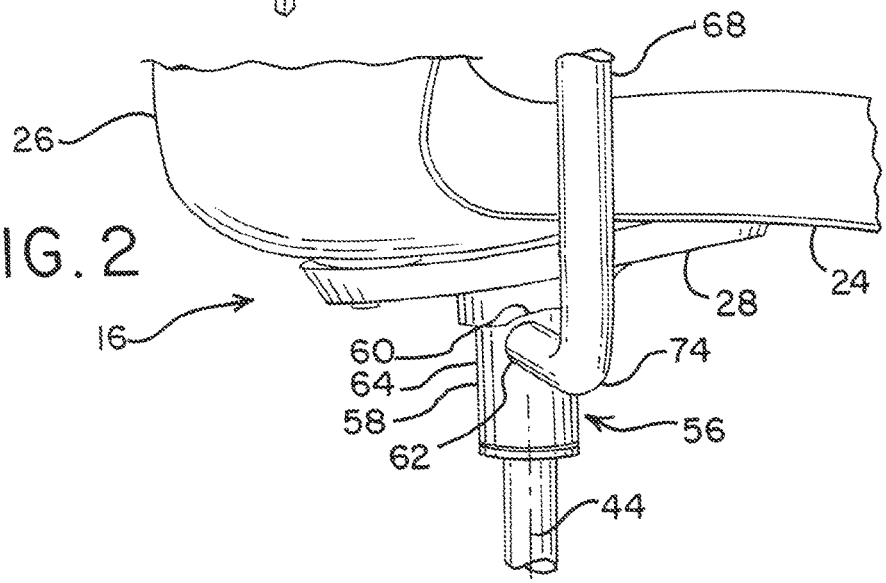
FIG. 2 is a partial, enlarged view of the connection between the seating unit of FIG. 1A and the worksurface assembly.
Figure 3:
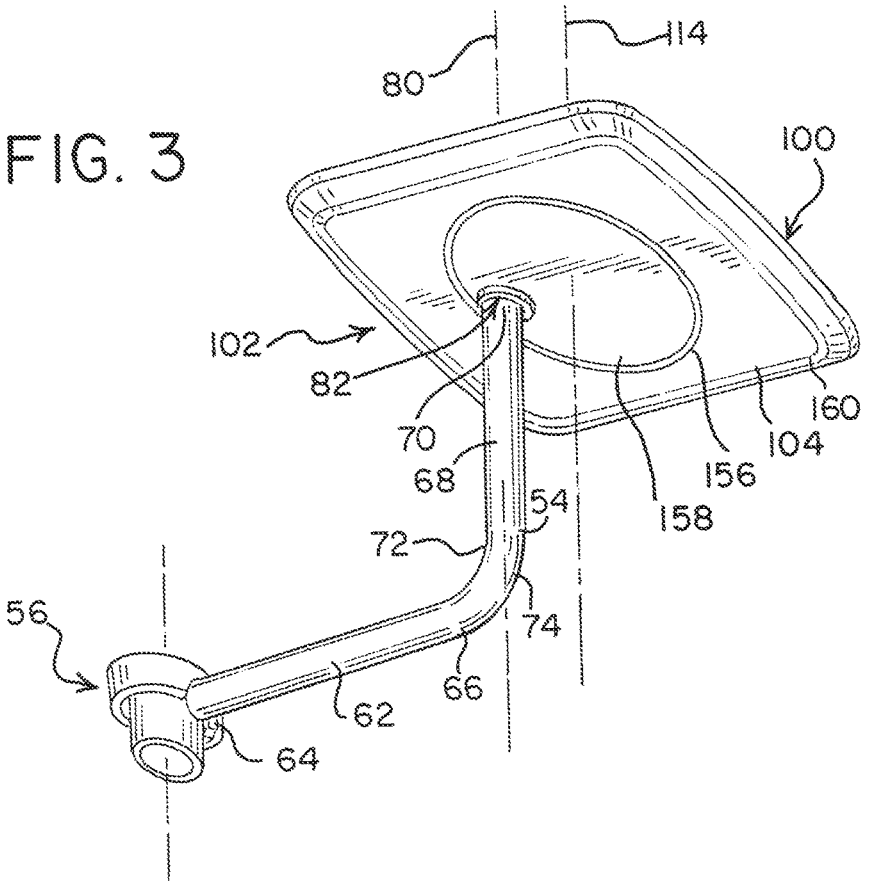
FIG. 3 is a bottom, perspective view of the worksurface assembly.
Figure 4:
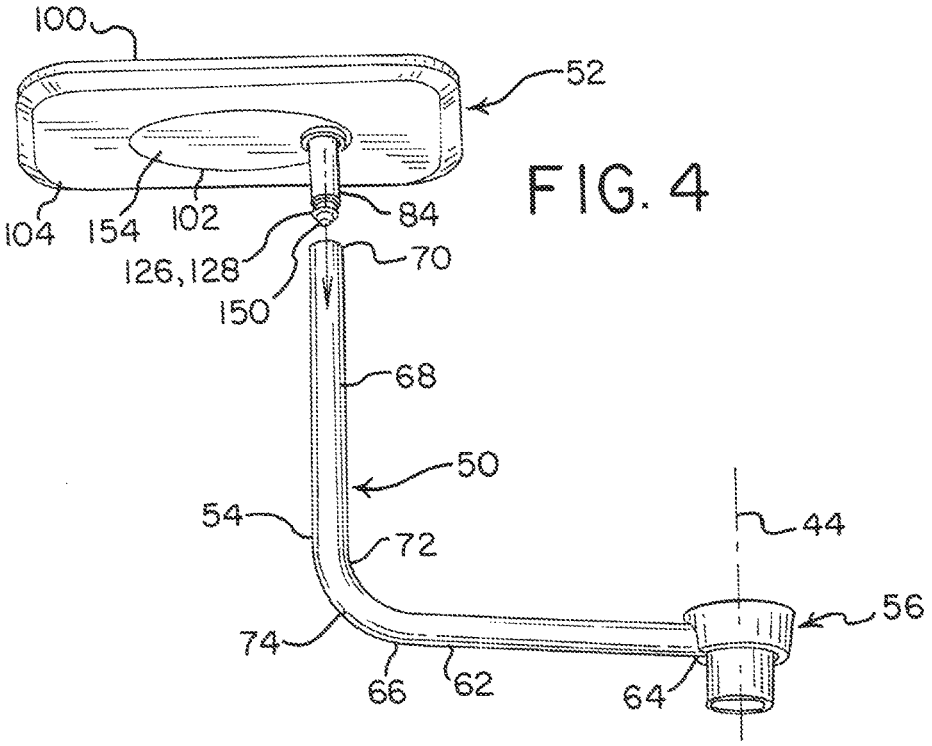
FIG. 4 is an exploded perspective view of upper and lower portions of the worksurface assembly shown in FIG. 3.

In yet another embodiment, shown in FIG. 1D, the body support assembly 12 is configured as a bed having a body support member 20. A central support element 340 is connected to the bed and is arranged along a side or end portion thereof. The central support element 340 defines the first pivot axis 44.

The various components of the seating unit shown in FIGS. 1A and B, including the central support, base and body support member, including a seat and backrest, are further disclosed and described in U.S. Pat. No. 8,696,056, the entire disclosure of which is hereby incorporated herein by reference. Components of another body support element, as shown for example in FIG. 1C, are disclosed in U.S. Pat. No. 8,950,817, the entire disclosure of which is also hereby incorporated herein by reference.

Worksurface Assembly

Lower Portion

Referring to FIGS. 1A-4, the worksurface assembly 14 includes a lower portion 50 and an upper portion 52. The lower portion 50 is configured as a support 54 having a first mounting portion 56. The first mounting portion 56 includes a collar 58 or hub, which is disposed around the central support element 40 and pivots about the first pivot axis 44, which is also the axis of rotation for the body support member 16 as discussed above. It should be understood that the mounting portion may be fixedly connected to the support column 42, and pivots as the support column rotates, or may be rotatable relative to the support column and is independently pivotable relative thereto. In either case, the first mounting portion 56 and support 54 are pivotable relative to the body support member 16 about the central pivot axis 44. It should be understood that the term "relative" includes either or both members moving.

The seat bracket 28 has a pair of stops 60 circumferentially spaced apart around the pivot axis 44, for example at 180 degrees. The support 54 includes a laterally extending portion 62 having a first end 64 configured with the first mounting portion 56. The laterally extending portion 62 extends laterally outwardly from beneath the seat with a second end 66 positioned laterally outwardly from the side of the chair. The laterally extending portion 62 pivots about the pivot axis 44, with the range of motion (e.g., 180 degrees) limited by engagement with one of the stops 60. In an alternative embodiment, the stops are eliminated and the laterally extending portion 62 may rotate completely around (360 degrees) the pivot axis 44.

The support 54 further includes an upright portion 68 having a first end 72 coupled to the second end 66 of the laterally extending portion. In one embodiment, the laterally extending portion and upright portion are configured as integrally formed bent tube, with the end portions forming a curved junction 74. The support may alternatively be made of separate components joined for example at the ends thereof. The upright portion 68 may be oriented along and define a second pivot axis 80 (which may be vertical), with the upright portion and laterally extending portions being substantially orthogonal. Alternatively, the upright portion may be angled slightly outwardly (or inwardly) relative to a vertical axis (e.g., pivot axis 44). The laterally extending and upright portions 62, 68, while disclosed as linear members, may be curved, curvilinear, or have other shapes as deemed appropriate and desirable. The upright portion 68 has a second end 70 spaced above both the first mounting portion 56 and a body support surface of the seat 24. The second end 70 defines in part a second mounting portion 82. In one embodiment, the upright portion 68 and second mounting portion 82 define the second pivot axis 80. The second end 70 and second mounting portion 82 may be terminated or positioned to support a worksurface 100 at a distance H above the body support surface of the seat 24, or other body support member. The distance H preferably may be at or between 7 and 13 inches, more preferably at or between 9.5 and 11 inches, and most preferably at or between 10 and 10.5 inches.

In one embodiment, the second mounting portion 82 includes a pivot bushing 84 inserted into the second end 70 of the upright portion, which is configured as a tube. The pivot bushing 84 further defines the second pivot axis 80. The pivot bushing 84 may be injection molded, or may include various interior bearing elements, such as needle or ball bearings. In one embodiment, the pivot bushing 84 is press fit into the second end 70 of the upright portion as further explained below.

Upper Portion

Referring to FIGS. 1 and 3-8, the upper portion 52 of the worksurface assembly includes a worksurface 100 and a pivot member 102. The worksurface has a profile, or outer peripheral contour 106, for example a substantially rectangular shape with curved corners. The worksurface may have other profiles, for example circular, elliptical, obround, polygonal, and so on, with linear or curved peripheral edges.

A lower pan 104, or bottom, is secured to the worksurface, for example with vibration welding, adhesives, fasteners, or combinations thereof. The worksurface 100 and lower pan 104 may be injection molded. It should be understood that the worksurface and lower pan may be integrally formed, for example by making the worksurface as a one-piece unit having an exposed bottom surface. It should be understood that the lower portion of the worksurface in such an embodiment defines a lower pan. In one embodiment, the lower pan 104 has substantially the same outer peripheral contour 106 as the worksurface. The lower pan 104 has an opening 108 formed therein. In one embodiment, the opening 108 is centrally located and has a circular shape. A plate 110 is sandwiched between the worksurface 100 and the lower pan 104 and forms a top overlying the opening 108. The plate 110 may be made of metal, or other bearing surface material, which is wear resistance. In one embodiment, the plate 110 is secured to the lower pan 104 with fasteners 111 (FIG. 7) before joining the worksurface 100 and lower pan 104. It should be understood, however, that the plate may be secured with adhesives, clamping, tabs, or other types of fasteners. A stud 112 extends downwardly from the plate 110 into the opening 108 and defines a third pivot axis 114. In one embodiment, the stud is commercially available from Penn Engineering and Manufacturing, located in Danboro, Pa. The stud 112 may be press-fit into the plate 110, or may be secured by welding, adhesives, threading, or other methods. The stud 112 is configured with threads. It should be understood that the plate may be omitted, with a bottom of the worksurface (whether configured with an opening or not) providing a bearing surface and being configured with a stud.

Figure 5:
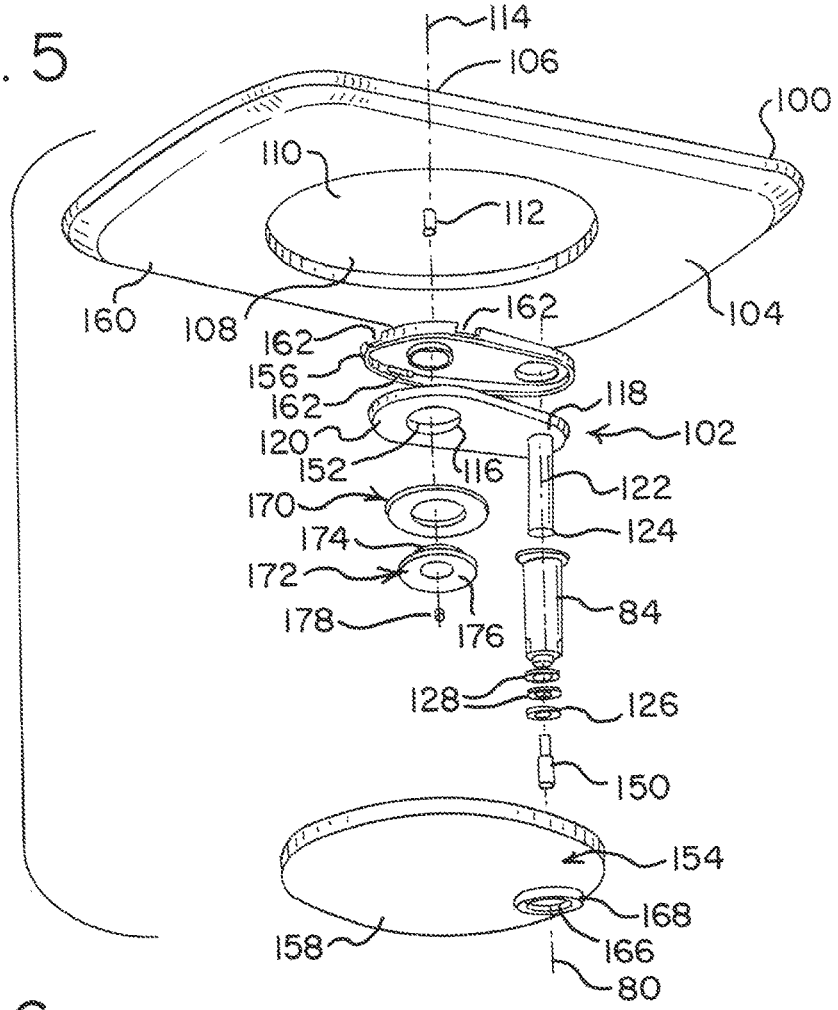
FIG. 5 is an exploded perspective view of the upper portion of the worksurface assembly shown in FIG. 4.
Figure 6:
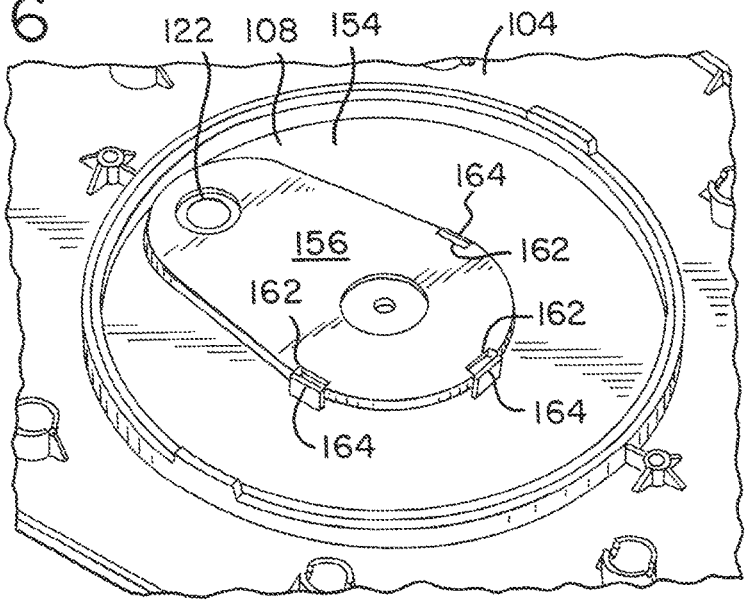
FIG. 6 is a partial, bottom view of the upper portion of the worksurface assembly.
Figure 7:
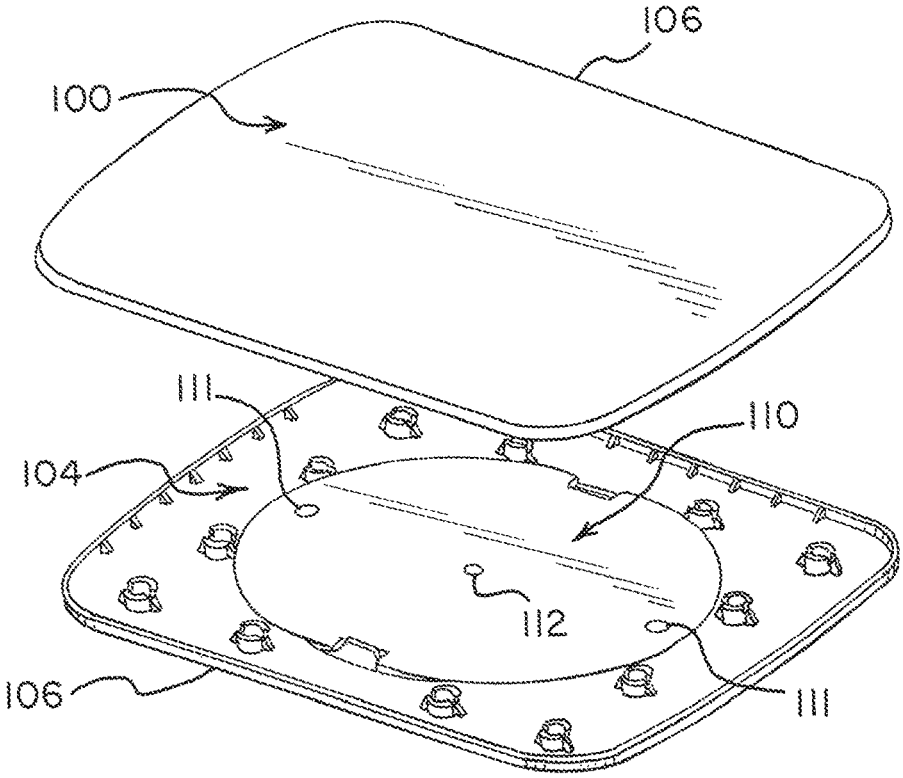
FIG. 7 is an exploded, perspective view of one embodiment of a worksurface.
Figure 8:
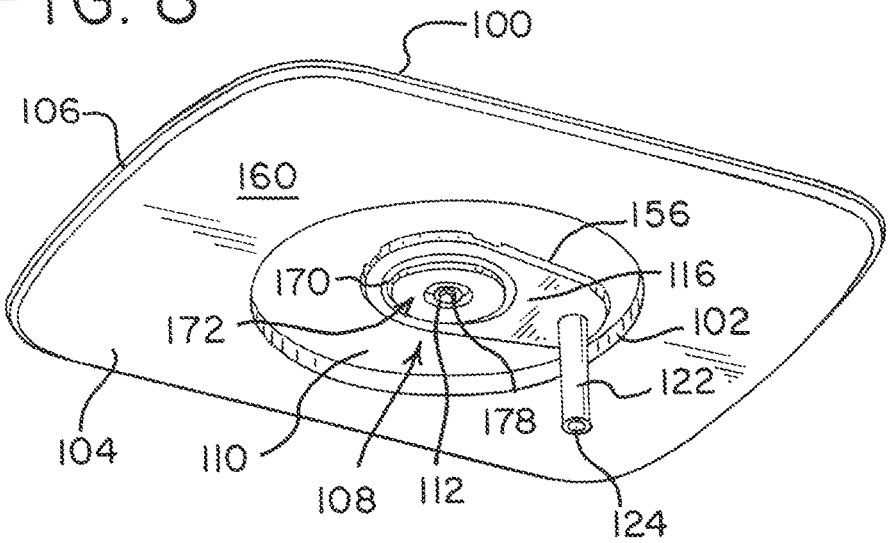
FIG. 8 is a partial, bottom view of the upper portion of the worksurface assembly.
Figure 9B:
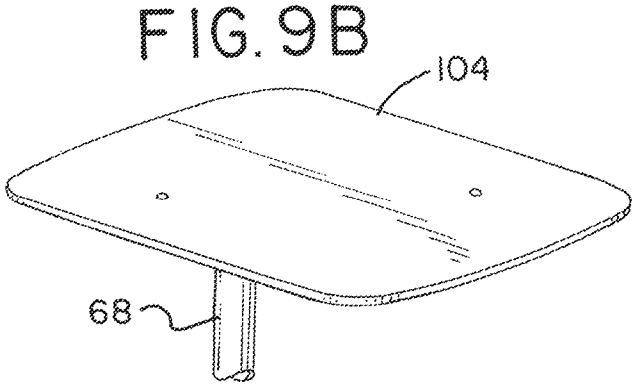
FIGS. 9A-F are various perspective views of another embodiment of an upper portion of a worksurface assembly in various states of assembly.
Figure 9D:
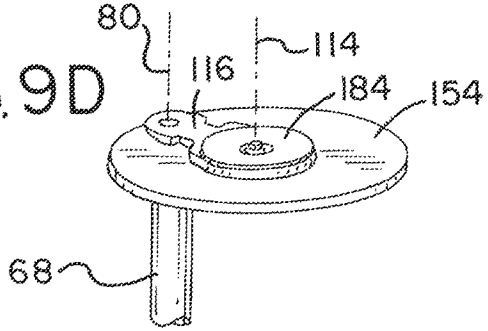
Figure 9F:
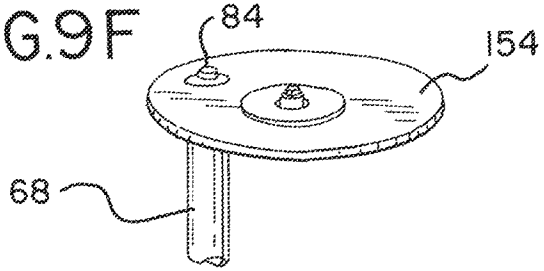
Figure 9A:
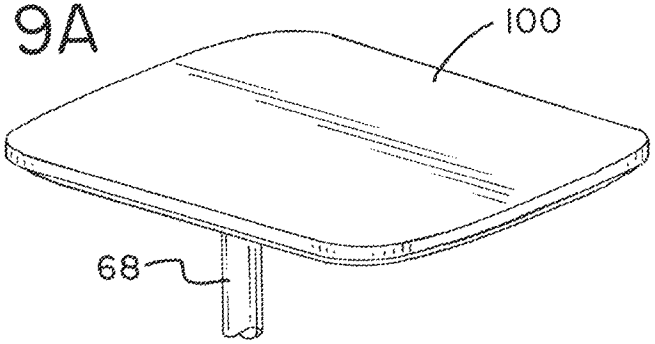
Figure 9C:
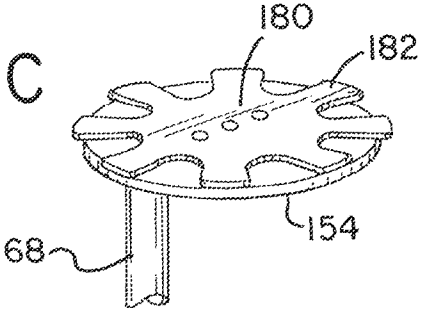
Figure 9E:
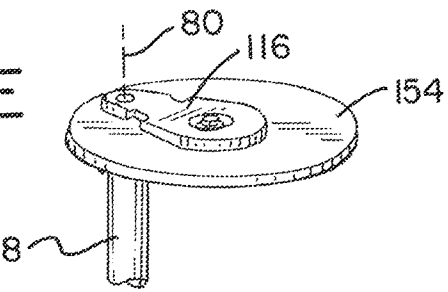
Figure 10:
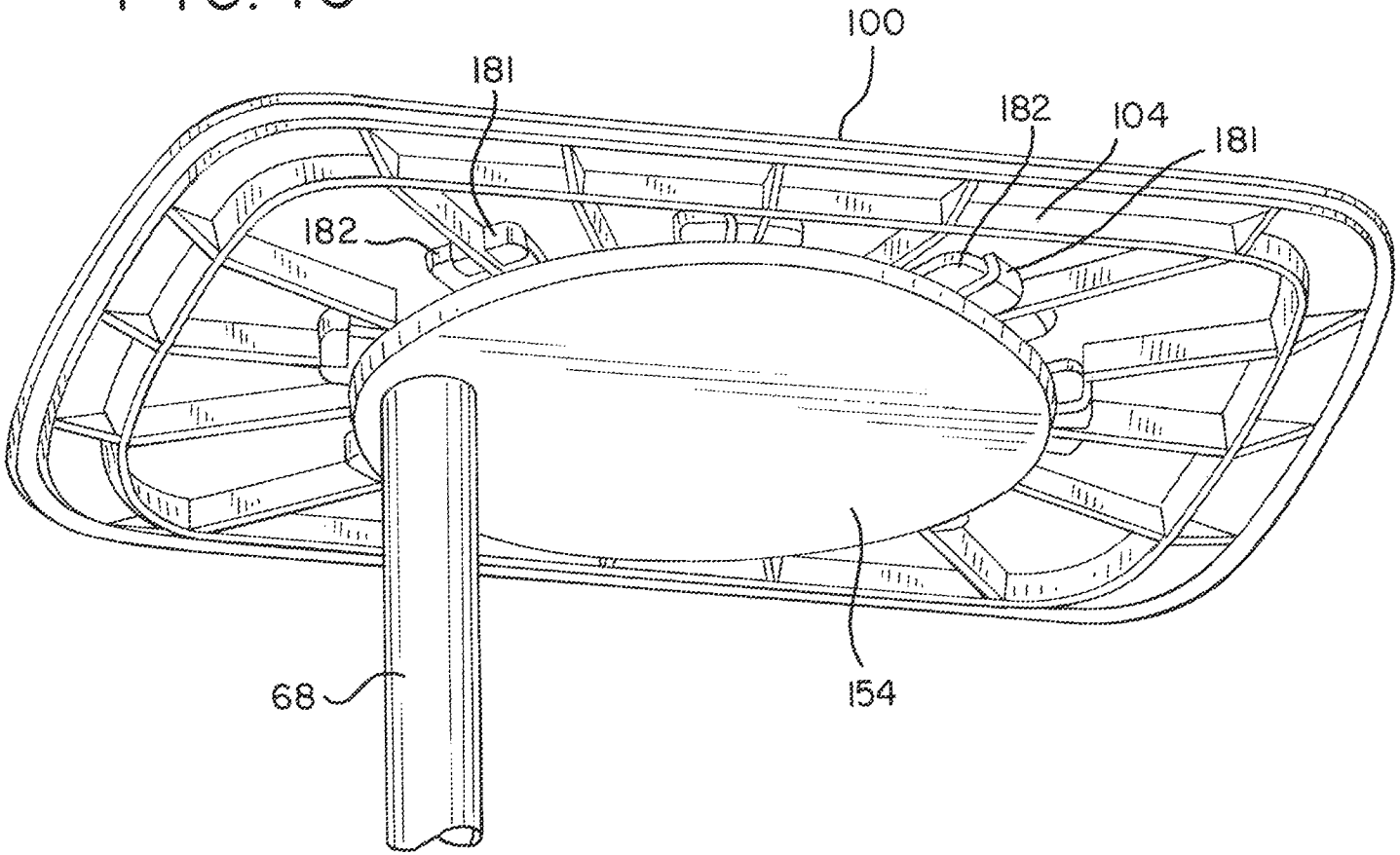
FIG. 10 is a bottom perspective view of the worksurface assembly shown in FIG. 9A.

Referring to FIGS. 5, 6 and 8, the pivot member 102 includes a link 116 having first and second ends 118, 120. A pivot shaft 122 is connected to one end 118 of the link 116 and extends orthogonal to a plane (e.g., horizontal) defined by the link 116. The pivot shaft 122 is inserted into the pivot bushing 84 and is rotatable relative to the pivot bushing 84 and upright portion 68 about the second pivot axis 80. Again, it should be understood that the term "relative" means either or both of the pivot shaft and pivot bushing may be moved. The pivot shaft 122 may be joined to the link by welding, threaded engagement, or integrally formed or machined therewith. In one embodiment, the link 116 and pivot shaft 122 are made of metal, for example steel. An end 124 of the pivot shaft 122 is provided with a threaded opening. A plurality of washers 126, 128, including in one embodiment a flat washer 126 and a pair of Bellville washers 128, are disposed on an end of the pivot bushing 84. A fastener 150, such as a shoulder bolt, is inserted through the washers 126, 128 and is threaded into the end 124 of the pivot shaft 122, thereby joining the link 116 to the pivot bushing 84. This assembly may be completed before press fitting the pivot bushing 84 into the upright portion 68. The connection between the pivot shaft 122 and pivot bushing 84 allows the pivot shaft 122 to rotate freely about the second pivot axis 80, but without play, inside the pivot bushing 84.

The opposite end 120 of the link 116 is provided with a through opening 152 defining the third pivot axis 114, which is laterally spaced apart from the second pivot axis 80. The second and third pivot axes 80, 114 may be spaced apart a distance at or between 2 and 6 inches. The link 116 is non-rotatably secured to a second lower pan 154, or cover, with a securing member 156, which also functions as a bearing member. In one embodiment, the second lower pan 154 has the same outer peripheral profile as the opening 108 (e.g., circular) in the first pan, with the bottom surfaces 158, 160 of the pans 104, 154 being substantially flush. The securing member 156 has a plurality of recesses 162 engaged by tabs 164 extending upwardly from the second pan 154 so as to provide a snap fit connection therebetween, with the link 116 sandwiched between the securing member 156 and second pan 154.

The second pan 154 includes a through opening 166 laterally spaced from the center axis 114 and coaxial with the second pivot axis 80. An annular flange 168 is formed around the opening and abuts the second end 70 of the upright portion 68 of the support 54. An upper end of the pivot bushing 84 is disposed between the worksurface 100 and second pan 154. It should be understood that in this way, the link 116 is disposed between an upper surface of the worksurface 100 and the lower surface 160 of the first pan 104, such that the link 116 is substantially parallel with the worksurface 100, and is coplanar with and disposed within a thickness T of a worksurface member, defined by the worksurface 100 and pan 104. The thickness T is preferably at or between 0.5 and 2 inches, and more preferably at or between 0.75 and 1 inch. In one embodiment, the worksurface 100 and link 116 both lie in substantially horizontal planes.

A washer 170, or bearing member, is disposed around the opening 152 in the link member 116. In one embodiment, the washer is made of Acetal. A flange bushing 172, having a cylindrical hub 174 and annular flange 176, is inserted through the washer 170 and opening 152 so as to align the washer 170 around the pivot axis 114. A fastener 178, such as a nut, is then coupled to the stud 112 (e.g., by threadable engagement), which extends through the securing member 156, the link 116, the washer 170 and the flange bushing 172 so as to connect the link 116 to the worksurface 100. In this way, the flange bushing 172 is non-rotatably secured to the worksurface 100, but with the pivot member 102 (in particular the link 116) and washer 170 sandwiched therebetween. The securing member 156 bears against the plate 110 and provides a wear surface therebetween as the link 116 pivots relative to the worksurface 100. Conversely, the washer 170 provides a wear surface between the link 116 and the flange bushing 172 as the link 116 rotates relative to the bushing 172. The worksurface 100 may rotate 360 degrees relative to the pivot member 102 and lower pan 154 about the third pivot axis 114.

In an alternative embodiment, the second pan 154 defines the pivot member. In this embodiment, the pivot link, securing member, washer and bushing are omitted. Instead, the second pan 154 bears against the plate 110, or alternatively directly against the bottom of the worksurface 100. In this embodiment, the second pan 154 is pivotally connected to the end 70 of the upright portion, for example with a pivot bushing, or directly with a collar, such as the annular flange 168.

In yet another embodiment, shown in FIGS. 9A-E and 10, a worksurface 100 is joined to a lower pan 104, which is non-rotatably connected to a support 180, configured with a plurality of radially extending fingers 182 engaging tabs 181 formed on an underside of the worksurface. A pan member 154 and the link 116 are secured to the upright as described above, but with a pivot disk 184 pivotally connected to the link 116 about the third pivot axis 114. The support 180 is non-rotatably connected to the pivot disk 184, such that the support 180, and connected worksurface 100, may rotate relative to the pivot link 116 about the third pivot axis 114.

In all of the various embodiments, the pivot member 102, whether configured as the link 116 alone, the second pan member 154 alone, or the two in combination, are substantially planar and preferably lie within a horizontal plane as disclosed above. In this way, the worksurface 100 is provided with two degrees of pivoting or rotational freedom relative to a single pivot axis 80 of the upright 68, which minimizes the clutter beneath the worksurface and maximizes the leg room available to the user. Moreover, because the link 116 and/or pan 154 are disposed under the worksurface, the worksurface 100 overlies the second and third pivot axes 80, 114 in all positions of the support 54, pivot member 102 and worksurface 100. Stated in another way, the pivot axes 80, 114 always intersect the worksurface 100 in all positions of the support 54, pivot member 102 and worksurface 100.

As noted, the pivot member 102 extends substantially horizontal, and defines a horizontal plane, between the second and third pivot axis 80, 114, and extends or is disposed between the worksurface and lower pan, or within the thickness T of the worksurface member made up of those two components (whether separate or integrally formed), such that the worksurface assembly provides a simple, elegant appearance while providing for three unique pivot axes 44, 80, 114. Moreover, the worksurface may be pivoted about the second axis 80 without encroaching upon and interfering with the user's legs. Preferably, the first, second and third pivot axes 44, 80, 114 are parallel, but it should be understood that they need not be parallel. Moreover, one or more of the first, second and third axes are preferably substantially vertical, and are horizontally spaced apart, with the worksurface forming a substantially horizontal, upper surface. The worksurface, pivot member and support are each independently pivotable about their respective pivot axes relative to each other, meaning each of those components may be pivoted individually, or collectively, regardless of the position or pivotable movement of the other components.

Operation and Assembly

In operation, a user 200 (see, e.g., FIG. 1B), whether seated or standing, may rotate the worksurface 100 toward and away from the body support member 16, 18, 20, whether by moving the worksurface 100 alone about the third axis 114, or by moving the worksurface 100 and pivot member 102 about the second axis 80, or by moving the worksurface 100, pivot member 102 and support 54 about the first axis 44, or some combination thereof, for example, in a sequential order. In particular, the user 200 may rotate the first mounting portion 56 of the support about the first pivot axis 44, and thereby pivot the support 54 and a second mounting portion 82 about the first pivot axis 44. The user may also pivot the pivot member 102, including the link 116, about the second pivot axis 80, and rotate the worksurface 100 about the third pivot axis 114, or perform those operations in various combinations. The worksurface 100 overlies, and intersects, the second and third pivot axes 80, 114 in all of the pivot member and worksurface positions. The worksurface 100 may be moved to any desired position, for example to facilitate ingress and egress, or to allow a user to interface comfortably with various objects supported on the worksurface. In addition, the worksurface may be manipulated to share information available on a device situated on the worksurface, for example a laptop, book or other device, without having to reposition the device on the worksurface.

The assembly may be particularly useful for example in various office, learning, and patient care environments, such as exam rooms.

A method of assembling a worksurface assembly includes pivotally securing the first mounting portion 56 to a central support member 40, such as the support column 42, for example by inserting the support column 42 through the first mounting portion 56. A plate 110 is sandwiched between the worksurface and lower pan 104. A pivot member 102, including a securing member 156 and link 116, is secured to a stud 112 extending from the plate with a nut 178, clamping a bushing 172 and a washer 170 against the link 116. A pivot bushing 84 is secured to a pivot shaft 122 with a fastener 150. A second pan 154 is then slipped over the pivot bushing 84 and is snap fit to the securing member 156 in a non-rotatable relationship, with the second pan 154 disposed in an opening 108 formed in the first pan. The pans may have flush bottom surfaces 158, 160. Finally, the bushing 84 is press fit into the end 79 of the upright portion 68.

In another embodiment, a support 180 is coupled to a pivot member 184 pivotably supported on the pivot member 102. The worksurface 100 and pan 104 are snap fit to the support 180 with one or more, and preferably a plurality, of radially extending fingers 182.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A worksurface assembly comprising:

a support having a first mounting portion defining a first pivot axis, and a second mounting portion defining a second pivot axis, wherein the second mounting portion is spaced above the first mounting portion, and wherein the first and second pivot axes are spaced apart;

a pivot member pivotally coupled to the second mounting portion, the pivot member pivotable relative to the support about the second pivot axis, wherein the pivot member is pivotable about the second pivot axis to a plurality of pivot member positions; and a worksurface rotatably coupled to the pivot member about a third pivot axis, wherein the third pivot axis is spaced apart from the second pivot axis, wherein the worksurface overlies the second and third pivot axes in all positions of the worksurface, and wherein the worksurface is rotatable about the third pivot axis independent of the pivot member position of the pivot member.

2. The worksurface assembly of claim 1, wherein the pivot member comprises a link extending between the second and third pivot axis, and further comprising a lower pan member coupled to the link, wherein the link is disposed between the lower pan member and the worksurface.

3. The worksurface assembly of claim 2 wherein the lower pan member is rotatable relative to the worksurface about the third pivot axis.

4. The worksurface assembly of claim 3 wherein the lower pan member is non-rotatably secured to the link.

5. The worksurface assembly of claim 3 wherein the lower pan member comprises a first lower pan member, and further comprising a second lower pan member surrounding the first lower pan member, wherein the second lower pan member is non-rotatably secured to the worksurface and is rotatable relative to the first lower pan member.

6. The worksurface assembly of claim 5 wherein the first and second lower pan members have substantially flush bottom surfaces.

7. The worksurface assembly of claim 2 further comprising a rotation member rotatably coupled to the link at the third pivot axis, wherein the worksurface member is coupled to the rotation member.

8. The worksurface assembly of claim 1 wherein the first, second and third axes are parallel and horizontally spaced apart, and wherein the worksurface comprises a substantially horizontal, upper surface.

9. The worksurface assembly of claim 1 wherein the support comprises a laterally extending portion comprising a first end configured with the first mounting portion and a second end laterally spaced apart from the first end, an upright portion having a first end coupled to the second end of the laterally extending portion and a second end vertically spaced apart from the first end of the upright portion, the second end of the upright portion defining the second mounting portion.

10. The worksurface assembly of claim 1 wherein the pivot member defines a horizontal plane between the second and third pivot axis.

11. A body support assembly comprising:

a base;

a central support element connected to the base;

a body support member coupled to the base; and the worksurface assembly of claim 1, wherein the first mounting portion is coupled to the central support element, and wherein the central support element defines the first pivot axis.

12. The body support assembly of claim 11 wherein the central support element comprises a vertically adjustable support column, wherein the body support member is coupled to the central support element and is moveable between a plurality of height positions.

13. The body support assembly of claim 12 wherein the first mounting portion is moveable with the body support member as the body support member is moved between the plurality of height positions.

14. The body support assembly of claim 11 wherein the worksurface and the second mounting portion are positioned above a body support surface of the body support member.

15. A worksurface assembly comprising:

a support pivotable about a first pivot axis to a plurality of support positions;

a pivot member pivotally coupled to the support about a second pivot axis spaced apart from the first pivot axis, wherein the pivot member is pivotable about the second pivot axis to a plurality of pivot member positions, wherein the pivot member is pivotable to the plurality of pivot member positions independent of the support position of the support; and a worksurface pivotally coupled to the pivot member about a third pivot axis spaced apart from the second pivot axis, wherein the worksurface is pivotable about the third pivot axis to a plurality of worksurface positions, wherein the worksurface is pivotable to the plurality of worksurface positions independent of the pivot member position of the pivot member and the support position of the support; and wherein the worksurface overlies the second and third pivot axes in all of the pivot member and worksurface positions.

16. The worksurface assembly of claim 15, wherein the pivot member comprises a link extending between the second and third pivot axis, and further comprising a lower pan member coupled to the link, wherein the link is disposed between the lower pan member and the worksurface.

17. The worksurface assembly of claim 16 wherein the lower pan member is rotatable relative to the worksurface about the third pivot axis.

18. The worksurface assembly of claim 17 wherein the lower pan member comprises a first lower pan member, and further comprising a second lower pan member surrounding the first lower pan member, wherein the second lower pan member is non-rotatably secured to the worksurface and is rotatable relative to the first lower pan member.

19. The worksurface assembly of claim 18 wherein the first and second lower pan members have substantially flush bottom surfaces.

20. The worksurface assembly of claim 15 wherein the support comprises a laterally extending portion comprising a first end defining the first pivot axis and a second end laterally spaced apart from the first end, an upright portion having a first end coupled to the second end of the laterally extending portion and a second end vertically spaced apart from the first end of the upright portion, wherein the second end of the upright portion is pivotally coupled to the pivot member, and wherein the upright defines the second pivot axis.

21. A body support assembly comprising:

a base;

a central support element connected to the base;

a body support member coupled to the base; and the worksurface assembly of claim 15, wherein the support is coupled to the central support element, and wherein the central support element defines the first pivot axis.

* * * * *